US006837843B2

(12) United States Patent
Gazeau et al.

(10) Patent No.: US 6,837,843 B2
(45) Date of Patent: Jan. 4, 2005

(54) EQUIPMENT FOR AUTOMATIC EXTRACTION OF NUCLEIC ACIDS

(75) Inventors: Michel Gazeau, Saint-Julien-en-Genevois (FR); Philippe Lare, Pers-Jussy (FR)

(73) Assignee: Genomic S.A. (FR)

( * ) Notice: Subject to any disclaimer, the term of this patent is extended or adjusted under 35 U.S.C. 154(b) by 29 days.

(21) Appl. No.: 10/062,036

(22) Filed: Jan. 31, 2002

(65) Prior Publication Data

US 2003/0103870 A1 Jun. 5, 2003

Related U.S. Application Data

(63) Continuation of application No. PCT/FR00/02225, filed on Aug. 2, 2000.

(30) Foreign Application Priority Data

Aug. 2, 1999 (FR) ..... 9910041

(51) Int. Cl.[7] ..... B04B 5/02

(52) U.S. Cl. ..... 494/10; 494/20; 366/214; 366/217; 366/218; 366/219

(58) Field of Search ..... 494/10, 16–18, 494/20, 31–33; 422/72; 366/208, 209, 213–215, 217–219

(56) References Cited

U.S. PATENT DOCUMENTS

| | | | | | |
|---|---|---|---|---|---|
| 660,746 | A | * | 10/1900 | Bausch et al. | 494/20 |
| 2,722,257 | A | * | 11/1955 | Lockhart | 494/20 |
| 3,163,404 | A | * | 12/1964 | Kraft et al. | 366/214 |
| 3,420,437 | A | * | 1/1969 | Blum et al. | 494/20 |
| 3,600,900 | A | * | 8/1971 | Buddecke | 62/3.2 |
| 3,712,535 | A | * | 1/1973 | Genese et al. | 494/17 |
| 3,850,368 | A | * | 11/1974 | Boeckeler | 425/430 |
| 4,068,798 | A | * | 1/1978 | Rohde | 494/20 |
| 4,848,917 | A | * | 7/1989 | Benin et al. | 366/208 |
| 4,990,130 | A | * | 2/1991 | Prais | 494/20 |
| 5,045,047 | A | | 9/1991 | Hutchins et al. | |
| 5,178,602 | A | | 1/1993 | Wells | |
| 5,567,050 | A | * | 10/1996 | Zlobinsky et al. | 366/209 |
| 5,707,331 | A | * | 1/1998 | Wells et al. | 494/20 |

FOREIGN PATENT DOCUMENTS

| | | |
|---|---|---|
| EP | 0 740 964 A1 | 11/1996 |
| WO | WO 99/21658 | 5/1999 |

* cited by examiner

*Primary Examiner*—David Sorkin
(74) *Attorney, Agent, or Firm*—Piper Rudnick LLP

(57) ABSTRACT

Apparatus for automatically extracting biological components from multiple distinct samples including a rotor supporting pendulous tubes and means for modifying the angular position of the tubes in a radial plane of the rotor independently of centrifugal force to cause a rocking movement of the tubes.

16 Claims, 3 Drawing Sheets

EQUIPMENT FOR AUTOMATIC EXTRACTION OF NUCLEIC ACIDS

RELATED APPLICATION

This is a continuation of International Application No. PCT/FR00/02225, with an international filing date of Aug. 2, 2000, which is based on French Patent Application No. 99/10041, filed Aug. 2, 1999.

FIELD OF THE INVENTION

The present invention pertains to the field of biological analysis, and more specifically to the field of equipment for the automatic extraction of biological components from distinct biological samples.

BACKGROUND

It is known to employ equipment comprising a rotor supporting pendulous tubes.

Such centrifugation equipment makes possible implementation of one of the steps of the analysis.

Numerous handling steps are required for adding the reagents, for collection or washing, and for recovering the samples.

Also known is U.S. Pat. No. 5,045,047 pertaining to centrifugation equipment for separation of the supernatant and the residue of a biological sample.

The rocking movement of the tubes is imposed by the centrifugal force and a mechanism prevents return to the vertical position.

European patent EP 740,964 pertains to another type of centrifugation equipment in which a blocking means prevents the containers from returning to their position of equilibrium.

The American patent U.S. Pat. No. 5,178,602 pertains to a type of centrifugation equipment in which the containers are maintained in the position acquired under the influence of the centrifugal force.

Patent WO 99/21,658 pertains to centrifugation equipment in which a mechanical means opposes the rocking movement under the effect of the centrifugal force.

Other patents, such as EP 838,265 and EP 106,398, describe centrifugation solutions.

SUMMARY OF THE INVENTION

The object of the present invention is to propose equipment enabling automation of an analysis protocol and simultaneous implementation, without manual intervention, of a multiplicity of extractions from multiple distinct samples, and communication to the tubes of periodic constrained rocking movement so as to induce agitation of their content. An additional goal of the invention is to propose equipment enabling periodic rocking movement with variable amplitude for the agitation of the tubes.

For this purpose, the invention pertains in its most general sense to equipment comprising means for inducing complete or periodic rocking movements of the tubes, independently of the centrifugal force.

The equipment comprises means for modifying the angular position of the tubes in the radial plane of the rotor independently of the centrifugal force, and for constraining the angular position of these tubes.

This characteristic makes it possible to implement transfers of reagents into the tubes without it being necessary to remove them from the centrifuge rotor and to drive the tubes with a periodic movement.

The equipment according to the invention advantageously comprises at least one stop which is mobile in a radial direction for inducing the rocking movement of the tube placed on the axis of displacement of said mobile stop.

According to a variant of implementation, the stop is formed by an inclined plate which is mobile along a radial axis inclined in relation to a horizontal axis.

The tubes are advantageously mobile in rotation by circa 180° between a vertical position and a tipped over position.

According to one specific mode of implementation, the equipment according to the invention comprises an annular receptacle for receiving the liquids discharged by the tubes during their rocking movements.

BRIEF DESCRIPTION OF THE DRAWINGS

Better comprehension of the invention will be obtained from the description below which refers to the attached drawings corresponding to a nonlimitative example of implementation in which.

DETAILED DESCRIPTION

Figure 1:
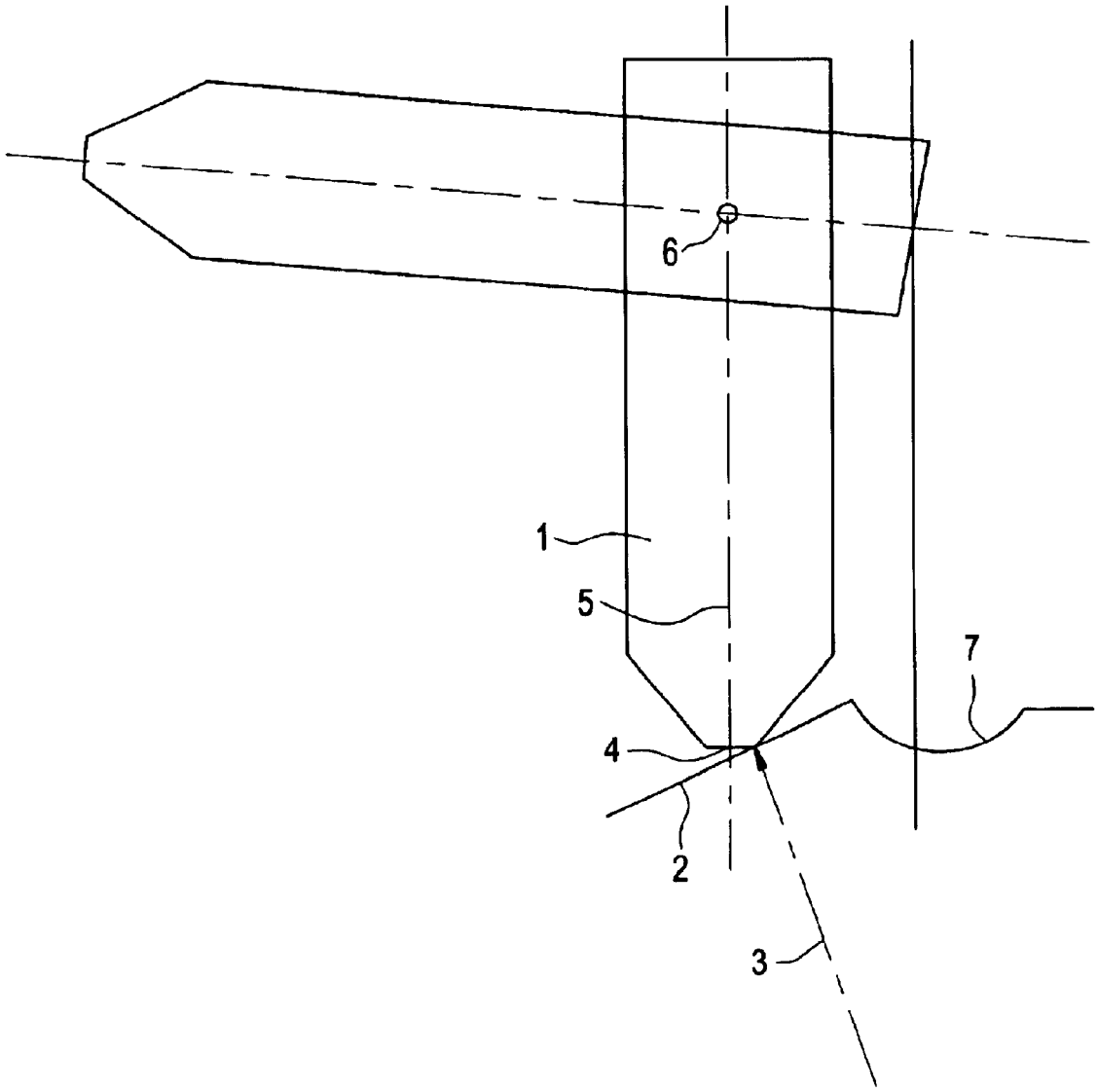
FIG. 1 shows a schematic sectional view of the equipment.
Figure 2:
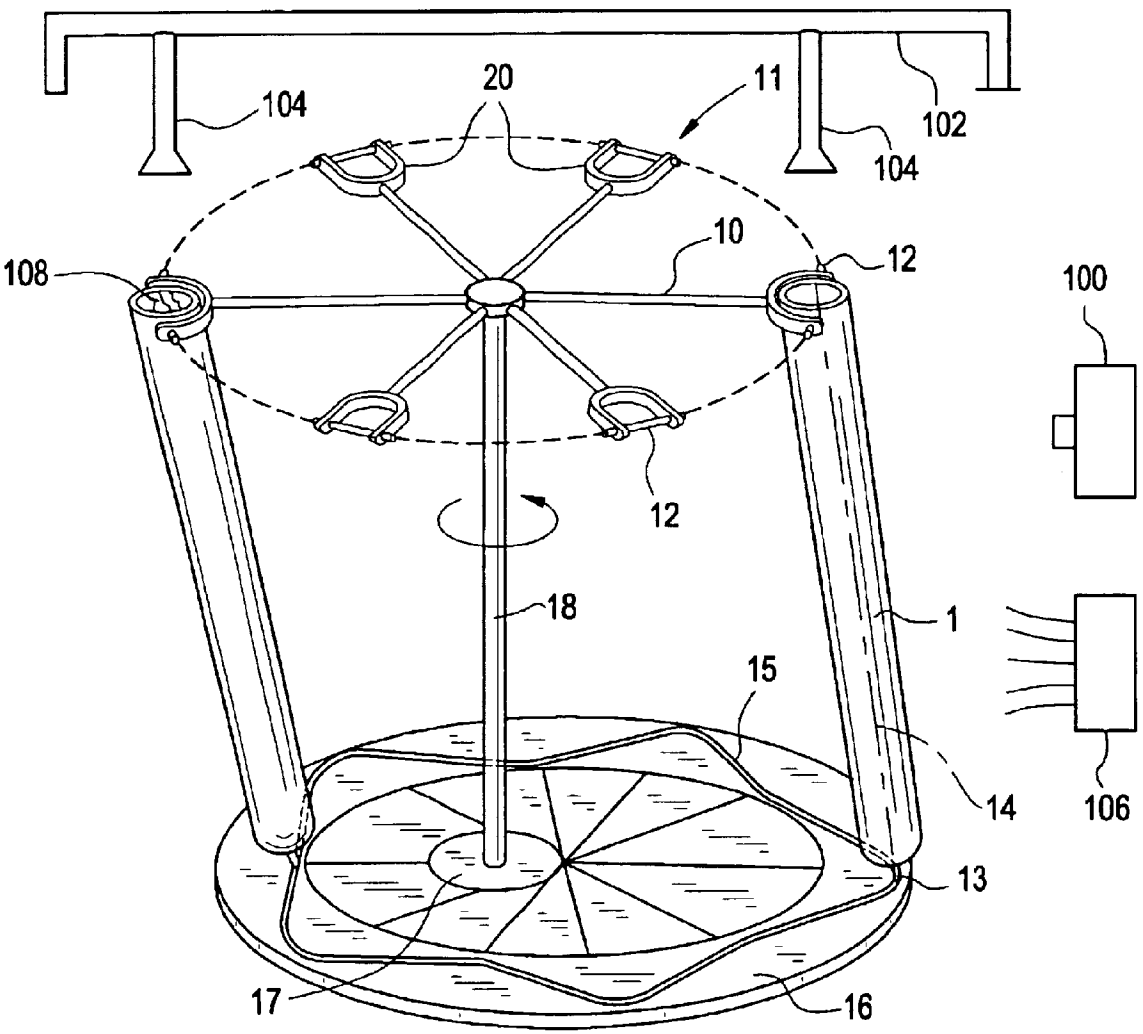
FIG. 2 shows an overall view of a variant of implementation.

Referring to the Drawings generally and FIGS. 1 and 2 in particular, the equipment according to the invention comprises a centrifugation rotor supporting pendulous tubes (1). In a known mariner, these tubes tilt under the effect of the centrifugal force. However, in contrast to the devices of the prior art, the tubes can also be tilted independently of the centrifugal force under the effect of a mobile stop (2) driven by a jackscrew or an electric motor or an endless screw. This mobile stop is inclined by an angle of approximately 60° in relation to a horizontal plane. It moves along a radial axis (3) inclined by an angle of approximately 30° in relation to the vertical. This stop comes in contact with the bottom (4) of the tube (1) and causes it to rock until it tilts over completely. The axis of displacement (3) cuts the median axis (5) of the tube offset from the pivoting point (6) so as to cause the complete tilting over of the tube (1).

The stop (2) can have the form of a crown which is mobile vertically as well as horizontally.

A collector (7) is provided for collecting the samples.

The tubes (1) or the cradles (20) supporting the tubes (1) can have at their bottom ends a guiding stud (13) which can be positioned in a slot (15) provided on a crown which is mobile vertically between a displaced position in which the tubes can rock freely and a working position in which the stud of each tube (1) is positioned in the slot (15) to assure oscillation of the tube (1) during rotation of the rotor (11), and a third position for the complete turning over of the tubes (1) for their emptying, during which the crown is in the high position. This crown can have displacement movements in horizontal planes to exert on the tubes (1) a rocking of variable amplitude.

The slot (15) has a width corresponding essentially to the section of the stud (13). It forms an annular path, oscillating on either side of a circular line with a displacement corresponding to the distance separating two consecutive tubes (1) or studs (13). The displacement of the oscillations is different from the displacement of the suspended tubes (1) to create a rocking of variable amplitude. When the stud (13) is positioned in the curved slot (15), rotation of the rotor (11) as well as the possible translational movement of the mobile disk bearing the slot (15) cause the rocking of the tubes (1) in both directions from a vertical position.

The equipment can also comprise a camera (100) intended to capture an image of a tube for the purpose of automatic measurement of the level height, the position of a meniscus or a separation zone of two phases, or verification of the presence of a tube at a rotor position.

The equipment comprises a computer for programming the various steps. As an example, an extraction protocol will be described below:

Tubes with a capacity of 50 ml are filled with a maximum of 15 ml of blood;

PBS is added to reach a volume of 40 ml and mixing is performed;

Centrifugation is performed for 5 minutes at 2000 G; the temperature is brought to 4° C.;

The tubes are then subjected to rocking movement so as to empty out the supernatant;

The preceding steps can possibly be repeated from the step comprising addition of PBS;

Filling is then performed up to the 35 ml level with a reagent composed of 9.54 g of $NH_4Cl$, 0.237 g of $NH_4HCO_3$ and qsp 100 ml of water;

Incubation is performed for 20 minutes at room temperature;

Centrifugation is then performed for 10 minutes at 2000 G at 4° C.;

The supernatant is again emptied out;

The tube is then rinsed with the aforementioned reagent;

The supernatant is put back in suspension with the same reagent;

Centrifugation is performed again for 10 minutes at 400 G or less at 4° C.;

Heating is then performed at 50° C. until equilibration of the temperature;

A solution of proteinase K at final 1 mg/l, preheated to 50° C., is added;

Incubation is performed at 50° C. for 3 or 4 hours with occasional agitation;

Precipitation is performed with ethanol (2 volumes) or isopropanol (0.6 volume);

Centrifugation is performed at 7000 or 8000 rpm for 15 minutes at 4° C.;

Washing is performed with 70% ethanol;

Draining is performed and the residue is dried.

All of these steps are performed in the equipment according to the invention without removing the tubes (1) from the rotor (11).

Figure 3:
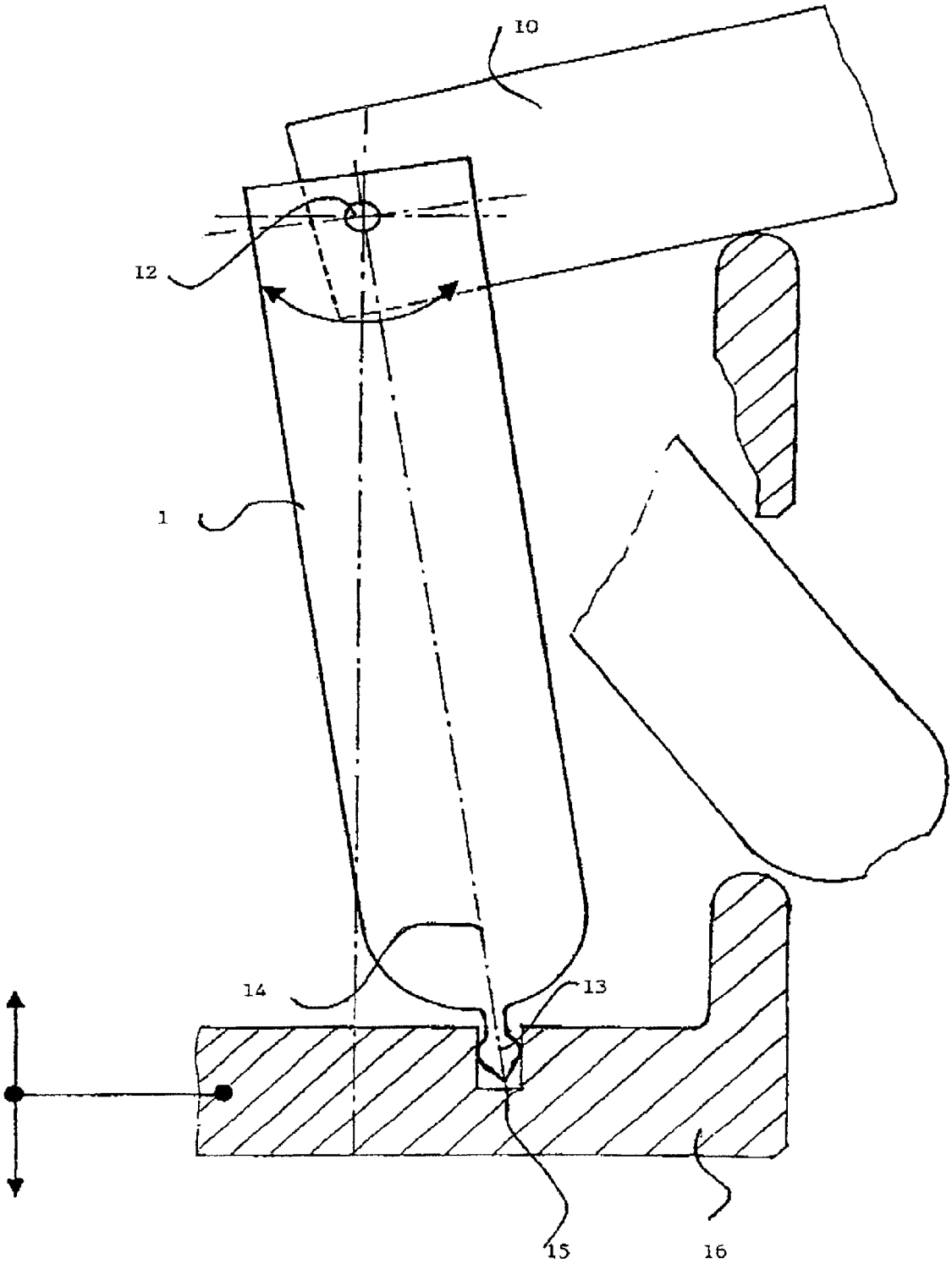
FIG. 3 shows a detail view of a tube suspended on the rotor and its guiding mechanism.

FIG. 2 shows an overall view of one embodiment and FIG. 3 shows a detailed view of a tube (1) suspended from the rotor (11) and its guiding mechanism.

FIG. 2 shows an embodiment in which the pendulous tubes (1) are suspended from the arm (10) of a rotor (11). The articulation between the tube (1) and the arm (10) is, for example, constituted by a pivot (12) oriented in a tangential direction. The tubes (1) thus can rock in a plane that is radial in relation to the rotor (11).

Each tube (1) is provided at its bottom part with a stud (13) extending in a direction essentially parallel to the median axis (14) of the tube. This stud (13) forms a guide piece that cooperates with a slot (15) formed in a tray (16). This tray can be fixed in rotation. It can also be driven by a movement of circular translation, resulting from an eccentric rotation, for example, or by guiding by a set of cams. It can also be driven by a movement of rotation in the same direction as the rotor or in the opposite direction. The axis of rotation (17) of the tray (16) can be offset in relation to the axis of rotation (18) of the rotor (11) to create a supplementary relative component. The slot (14) has a width corresponding essentially to the section of the stud to assure constrained guiding of the stud.

The slot (14) can be circular, with the tray (16) then being off-centered in relation to the axis (18) of the rotor (11). The slot can also have the form of a closed curve the radius of which varies periodically, e.g., in an essentially sinusoid manner.

When the tubes (1) are place on the rotor (11), the studs (13) are engaged in the slot (15) of the tray (16). When the rotor (11) begins to rotate, the relative displacement between the rotor (11) and the tray (16) causes a periodic movement o the stud (13) in relation to the reference point linked to the rotor (1) and thus a periodic rocking of the tube (1) in the radial plane. This constrained angular displacement is independent of the centrifugal force and causes agitation of the content of the tube (1). The periodicity of these rocking movements can be regulated by the relative rotational speed of the tray (16) and the rotor (11). The amplitude of these rocking movements is defined by the shape of the slot (15) and by the degree to which the tray (16) is offset in relation to the axis of the rotor (1). The tray (16) is mobile in translational movement along the axis (18) of the rotor (11) which assures in addition a rocking movement of the tubes (1) as a unit.

According to one particular mode of implementation, the rotor (11) is closed by a cover (102) traversed by nozzles (104) for depositing reagents in at least one tube (1).

According to another variant, the equipment comprises a stopper 108 to close the tubes for their sealing or unsealing.

The equipment preferably has thermoregulation means (106).

What is claimed is:

1. Apparatus for automatically extracting biological components from multiple distinct samples comprising:

a rotor supporting pendulous tubes; and means for modifying the angular position of the tubes in a radial plane of the rotor independently of centrifugal force to cause a rocking movement and complete turning over of said tubes to empty said tubes.

2. The apparatus according to claim 1, further comprising at least one movable stop to induce rocking movement of a tube placed on an axis of displacement of said movable stop.

3. The apparatus according to claim 2, wherein said stop is formed by an inclined plate which is movable along a radial axis inclined in relation to a horizontal axis.

4. The apparatus according to claim 2, wherein the stop is formed by a mobile crown which contacts the tubes.

5. The apparatus according to claim 1, wherein the tubes are rotatable by approximately 180° between a vertical position and a tipped over position.

6. The apparatus according to claim 1, wherein the rotor is closed by a cover traversed by nozzles for depositing reagents in at least one tube.

7. The apparatus according to claim 1, further comprising an annular receptacle for receiving liquids discharged by the tubes during rocking movement.

8. The apparatus according to claim 1, further comprising a stopper to close the tubes.

9. The apparatus according to claim 1, further comprising thermoregulation means.

10. The apparatus according to claim 1, further comprising a camera positioned to capture images of tubes.

11. Apparatus for automatically extracting biological components from multiple distinct samples comprising:

a rotor supporting pendulous tubes; and means for modifying the angular position of the tubes in a radial plane of the rotor independently of centrifugal force to cause a rocking movement of said tubes, wherein the tubes have on their bottom surface a stud which engages a slot provided on a mobile tray to induce an oscillating rocking movement of the tubes.

12. Apparatus for automatically extracting biological components from multiple distinct samples comprising:

a rotor supporting pendulous tubes; and means for modifying the angular position of the tubes in a radial plane of the rotor independently of centrifugal force to cause a rocking movement of said tubes, wherein each tube is provided at its bottom part with a stud forming a guide niece that cooperates with a slot formed in a tray.

13. The apparatus according to claim 12, wherein the center of displacement of the tray is offset in relation to an axis of rotation of the rotor.

14. The apparatus according to claim 12, wherein the slot is formed as a closed curve, the radius of which varies periodically.

15. The apparatus according to claim 14, wherein the radius varies in an essentially sinusoid manner.

16. The apparatus according to claim 12, wherein the tray is mobile in translational movement along an axis of the rotor.

* * * * *